United States Patent [19]

Cohrs

[11] Patent Number: 4,875,324

[45] Date of Patent: Oct. 24, 1989

[54] LOW PRESSURE CAP LIFT WITH HYDRAULIC RETURN

[75] Inventor: Donald E. Cohrs, Davenport, Iowa

[73] Assignee: The Kartridg Pak Co., Davenport, Iowa

[21] Appl. No.: 266,507

[22] Filed: Nov. 3, 1988

[51] Int. Cl.[4] ..... B65B 31/06; B65B 31/02; B65B 3/10

[52] U.S. Cl. ..... 53/88; 53/510; 53/268; 53/270; 53/330

[58] Field of Search ..... 53/470, 88, 89, 94, 53/269, 270, 283, 510, 268, 330

[56] References Cited

U.S. PATENT DOCUMENTS

| | | | |
|---|---|---|---|
| 2,958,170 | 11/1960 | Mayer, Jr. | 53/470 X |
| 2,963,834 | 12/1960 | Stanley et al. | 53/470 |
| 3,152,429 | 10/1964 | Stanley et al. | 53/88 |
| 3,157,974 | 11/1964 | Stanley et al. | 53/88 |
| 3,545,170 | 12/1970 | Leonard | 53/88 |
| 3,755,985 | 9/1973 | Rait et al. | 53/470 X |
| 3,977,151 | 8/1976 | Reever et al. | 53/88 X |
| 4,086,741 | 5/1978 | Williams | 53/88 X |

*Primary Examiner*—Horace M. Culver

*Attorney, Agent, or Firm*—Lockwood, Alex, Fitzgibbon & Cummings

[57] ABSTRACT

A crimper head for use in introducing a fluid product under pressure into the mouth of a container provided with a closure and thereafter crimping the closure to the container mouth. A container, such as for an aerosol package, with a closure resting freely in the mouth of the container is delivered to the crimper head. The head has a lower bell which forms a seal with the upper end of the container when the head is lowered. While the bell remains stationary, other parts of the head are actuated so that vacuum is applied to the bell and the container while the closure is lifted by vacuum from the mouth. Thereafter, the head is actuated to shut off the vacuum and admit a metered quantity of fluid under pressure, such as aerosol propellant, into the bell and container. When the pressurized fluid is admitted it lifts the closure from the container mouth and also acts to lift as a unit all parts of the head except the bell which remains stationary and engaged with the container. Only the combined weight of the lifted parts resists the lifting action. After the desired quantity of product has been introduced, one or more cylinders at the upper end of the head are actuated so as to restore the unit of lifted parts to their normal or lowered position. Thereupon, the collet in the head is actuated to crimp the closure to the mouth of the container.

21 Claims, 4 Drawing Sheets

2
5
21
24
32
35
36
2
17
47
16
25
23
34
33
10
3
31
3
30
26
27
15
18
28
45
60
57
48
46
43
66
58
50
12
54
14
63
64
51
65
65
53
49
13
11
55
52
68
81
61
67
56
61a
62
74
73
72
70
71

LOW PRESSURE CAP LIFT WITH HYDRAULIC RETURN

This invention relates generally to innovations and improvements in crimper heads which are used in apparatus and equipment that fill containers with pressurized product and/or propellants to form various aerosol packages. A wide variety of products have been long and widely available in aerosol packages including such items as insecticides, paint, hair spray, lubricants, etc. The art of filling containers with various products and/or propellants is highly developed and high speed apparatus and equipment for performing the product and/or propellant filling operations is also highly developed and commercially available.

One of the important units in a line for filling containers with product and propellant and applying closures thereto is known as the undercap filler. In a modern aerosol package production line, the undercap filler will usually have multiple crimping heads, e.g. 6–18 heads. Typically, containers are delivered to the undercap filler with product already introduced and with a closure assembly loosely set in the mouth of the container. The closure assembly includes in addition to the closure element or cap itself which seats on and becomes sealed to the mouth of the container, a dip tube extending down into the product and a discharge valve extending above the closure element. In each crimping head of an undercap filler, vacuum is first applied to the container, then a metered quantity of propellant in either liquid or gaseous form is introduced under pressure, after which the closure element is seated and crimped onto the mouth of the container.

One type of crimping head that has been used commercially with good success is disclosed in U.S. Pat. No. 3,157,974 issued Nov. 24, 1964 to Richard B. Stanley and Roy S. Rousseau, in particular, the crimping head disclosed in FIGS. 21–26 of U.S. Pat. No. 3,157,974 and operating in accordance with the modification and alternative operation described in column 15, lines 8–65. An improved crimping head design following the teachings of the Stanley and Rousseau U.S. Pat. No. 3,157,974 has been commercialized by the assignee of that patent, namely, The Kartridg Pak Co., of Davenport, Iowa. This improved commercial design will be referred to hereinafter.

The crimping head shown and disclosed in U.S. Pat. No. 3,157,974 and the successful commercial crimping head of The Kartridg Pak Co. rely on compression springs to restore lifted components of the crimping heads to their lowered position in which the closure element can be crimped to the container opening or mouth. In operation, certain components of these prior crimping heads are lifted when propellant or product is introduced into the heads under pressure. In order to achieve satisfactory operation of these prior crimping heads, several disadvantages have had to be accepted and coped with. According to the present invention, it is possible to eliminate the compression springs and the disadvantages attendant thereto.

Generally stated, the object of the present invention is the provision of a crimping head wherein the known and recognized disadvantages attendant to and associated with crimping heads utilizing compression springs for restoring or lowering components or elements raised by action of the pressure of the propellant or other pressurized fluids, are eliminated and replaced with other means resulting in important and worthwhile advantages.

More specifically, an important object of the present invention is the provision of crimper heads of the type disclosed in Stanley and Rousseau U.S. Pat. No. 3,157,974 and the commercial versions thereof available from The Kartridg Pak Co. in which the return compression springs have been eliminated and the following advantages have been obtained: Improved safety, reduced wear, decreased propellant and operating pressures, elimination of high pressure propellant pumps which are costly and expensive to maintain, minimized lift resistance, positive closure sealing, increased output, reduced propellant loss, entire container opening available during fill instead of a restricted slit clearance - thereby reducing tendency to dislodge closure gaskets, reduced seal loading, reduced can loading, and increased output.

Certain other objects of the invention will become apparent to those skilled in the art in view of the following detailed description of a presently preferred embodiment of the invention taken in conjunction with the accompanying drawings, wherein.

Figure 1:
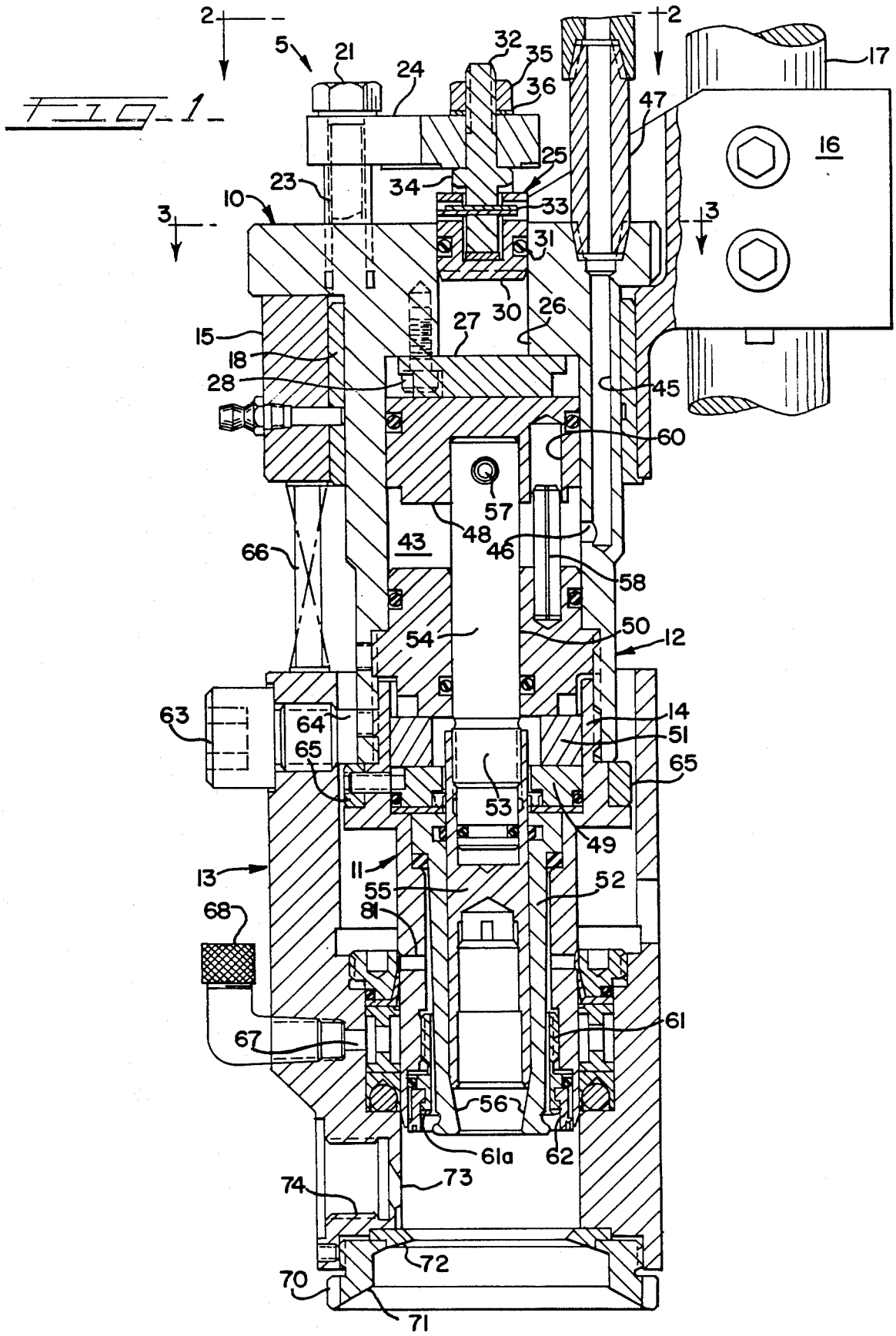
FIG. 1 is a vertical sectional view of a crimping head embodying the present invention taken on line 1—1 of FIG. 2.
Figure 7:
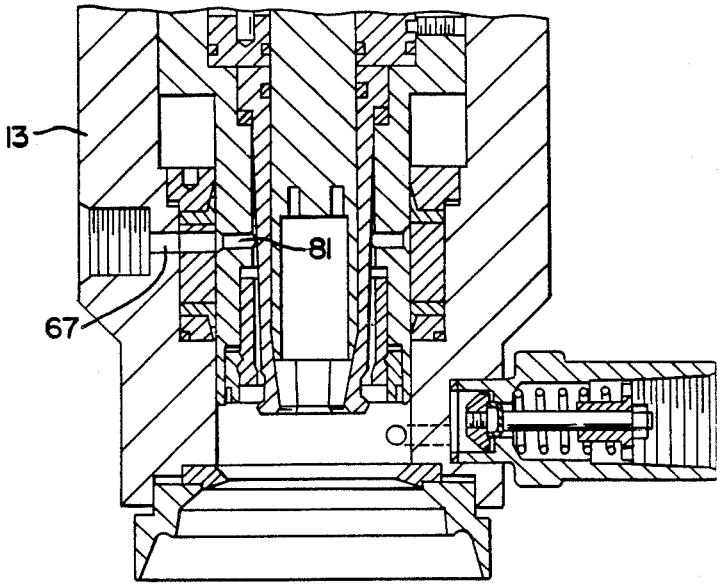
Figure 8:
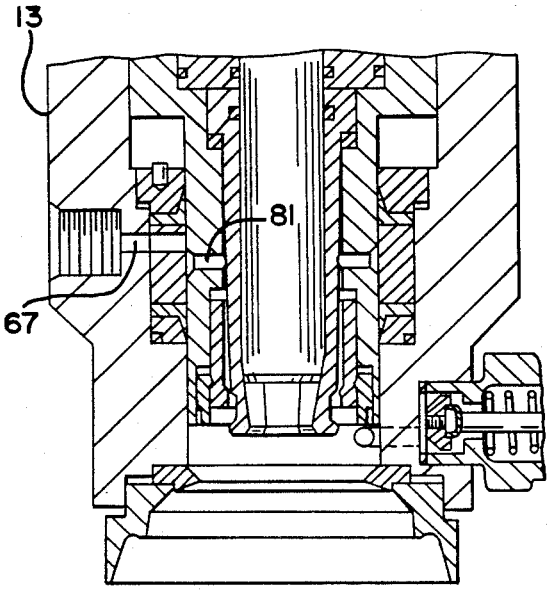
Figure 9:
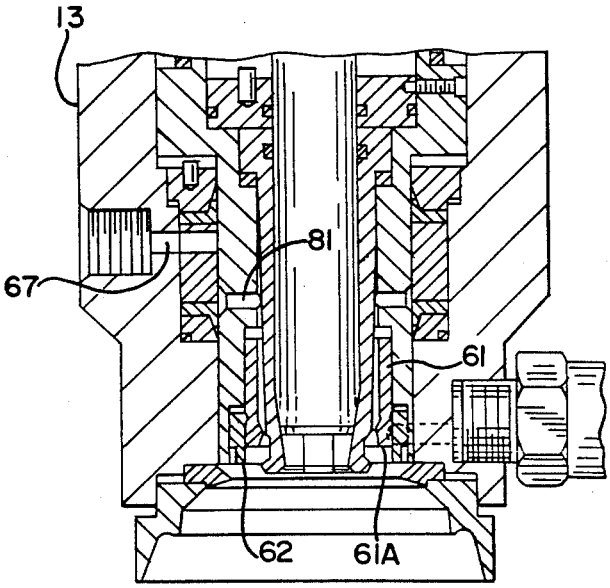
Figure 10:
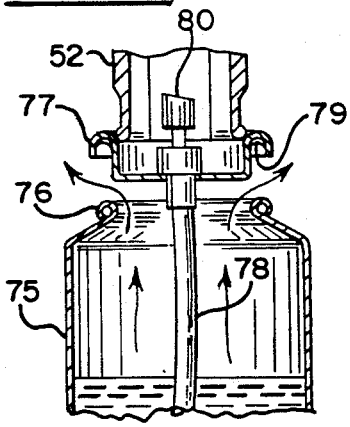
Figure 11:
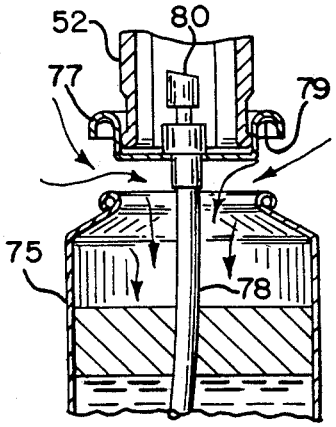
Figure 12:
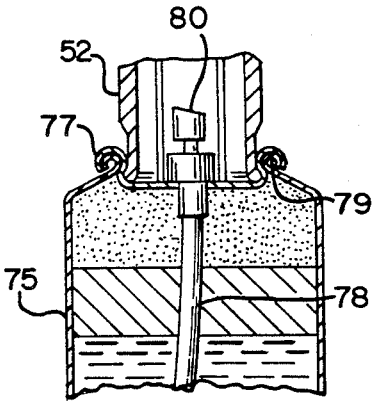
Figure 13:
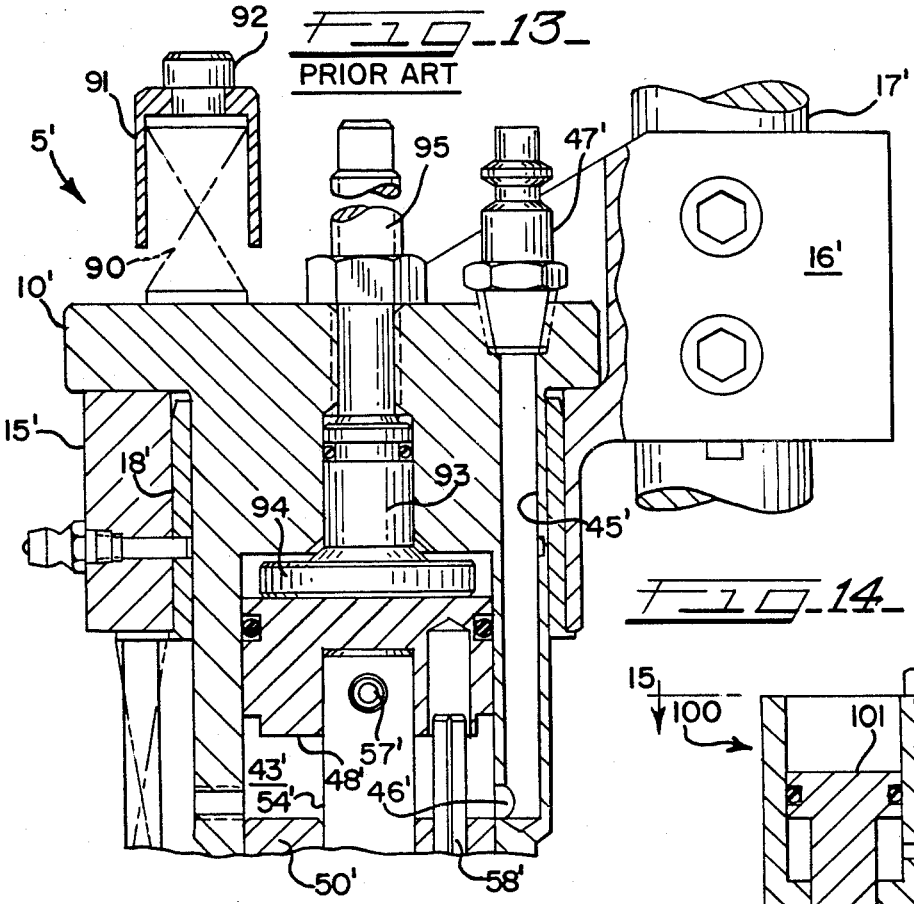
FIG. 13 PRIOR ART
Figure 14:
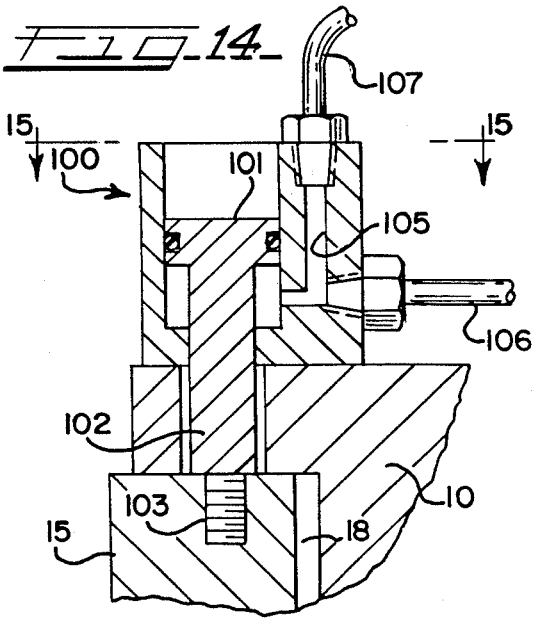
Figure 15:
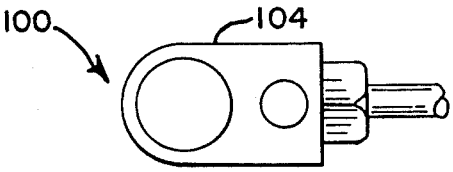

FIGS. 7, 8, and 9 are fragmentary sectional views showing the parts contained in the lower portion of the crimping head shown in FIG. 1 occupying three different positions corresponding to vacuumizing, propellant filling and closure crimping operations, respectively;

FIGS. 10, 11 and 12 are diagrammatic views illustrating relative positions of the closure cap and collet during the vacuum, pressure fill and crimping operations, respectively;

FIG. 13 is a fragmentary vertical sectional view of the upper portion of a crimping head representing the current state of the prior, art;

FIG. 14 is a fragmentary vertical section of a second embodiment of the invention; and FIG. 15 is a top plan view of FIG. 14.

Referring to FIGS. 1–6, a crimping head is indicated generally at 5 which embodies the present invention. The head 5 comprises an upper cylinder head 10 to the lower end of which is attached a lower cylinder 11. The cylinder 11 and the lower end 12 of the upper cylinder head 10 are surrounded by an outer container-engaging bell 13. The lower end 12 of the upper cylinder head 10 is internally threaded so as to receive the upper threaded end 14 of the inner cylinder 11.

The crimping head 5 will normally be one of a number of heads (e.g. 6–18) incorporated in a propellant and/or product undercap filler of the general type shown and described in Stanley and Rousseau U.S. Pat. No. 3,157,974, the disclosure of which is incorporated herein by reference. The crimping head 5 will be mounted so as to be vertically slidable in the sleeve portion 15 of a bracket 16 carried by a cam actuated, vertically reciprocating post 17. As described in U.S. Pat. No. 3,157,974, the vertical reciprocation of the post 17 is controlled by a cam whereby the head 5 and related parts of the overall machine perform a certain cycle of operations which are described below in connection with FIGS. 10–12.

The sleeve 15 is preferably provided with a bushing 18. The upper end of the upper cylinder head 10 is square as shown in FIGS. 2 and 3 so as to provide four rounded corners whereby the head 5 can be suspended in the sleeve 15 with the four corners resting on the upper end of the sleeve 15 as shown in FIG. 1.

Figure 2:
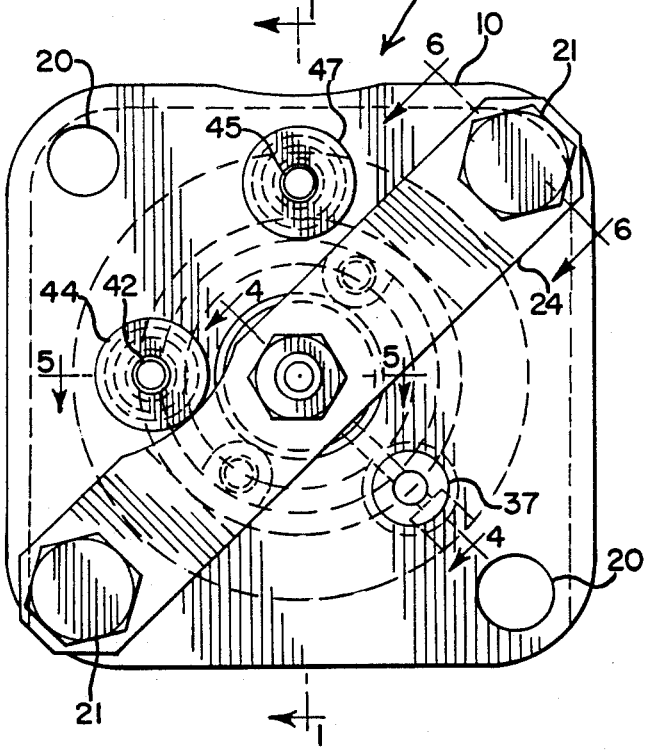
FIG. 2 is a top plan view of the crimping head shown in FIG. 1 taken on line 2—2 of FIG. 1.
Figure 3:
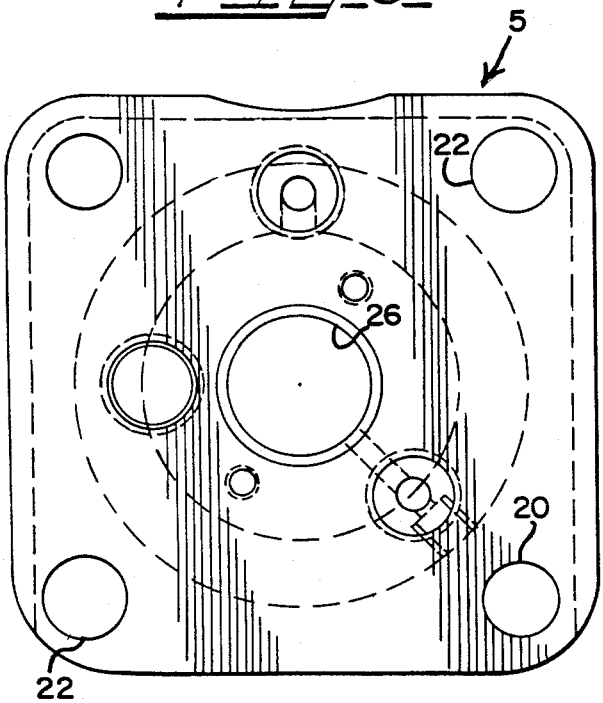
FIG. 3 is a top plan view taken on line 3—3 of FIG. 1.
Figure 5:
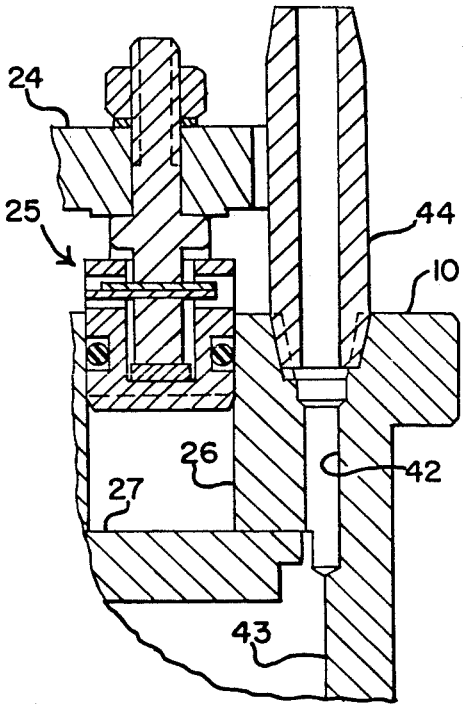
FIG. 5 is a fragmentary sectional view taken on line 5—5 of FIG. 2.
Figure 6:
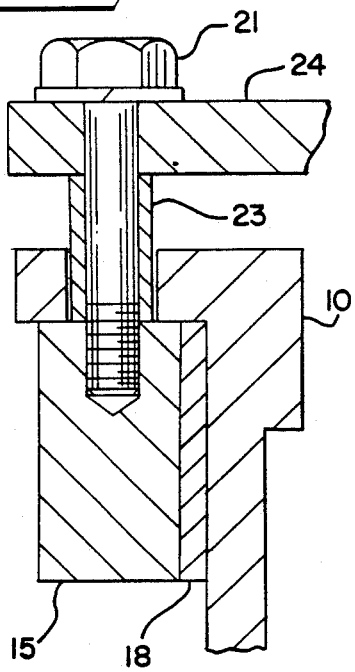
FIG. 6 is a fragmentary sectional view taken on line 6—6 of FIG. 2.

Referring to FIGS. 2, 3 and 6, thru-holes 22–22 are drilled through diagonally opposed corners of the upper end of the cylinder head 10 to provide clearance for spacer collars 23 (FIGS. 1 and 6) through which extend hex-headed bolts 21—21. The ends of bolts 21 are screwed into the top of sleeve 15 so as to be fastened thereto and clamp spacers 23 and a crossbar 24 rigidly to the sleeve 15. The crossbar 24 serves to support at its midpoint a stationary piston assembly indicated generally at 25.

It will be seen that by selecting the length of spacer collars 23 the distance between the underside of the crossbar 24 and the top surface of the head of cylinder head 10 may be vertically adjusted. Such selection determines the extent to which the cylinder head 10 can be lifted in respect to the stationary outer bell 13 as will be described below. When the cylinder head 10 is lifted relative to the sleeves 23 as will be described below, its upper movement will be arrested by the crossbar 24 and in turn by the heads of the bolts 21. If desired, bolts (not shown) may be inserted in thru-holes 20—20 and fastened into the sleeve 15. The undersides of the heads of such bolts should be co-planar with the underside of crossbar 24.

Referring to FIG. 1, a central opening 26 is provided through the head of the cylinder head 10 and the bottom end thereof is closed by a cap 27 secured in place by a plurality of bolts 28, the shanks of which extend into threaded holes provided therefore.

The piston assembly 25 comprises a piston 30 which fits slidably within the cylindrical opening or well 26. The piston 30 carries an O-ring 31 and is supported from the crossbar 24 by a threaded stem 32. The piston 30 is supported on the stem 32 by a crosspin 33, a collar 34 engages the underside of the crossbar 24 and cooperates with a nut 35 and lock washer 36 to position the piston 30 with respect to the crossbar 24.

Figure 4:
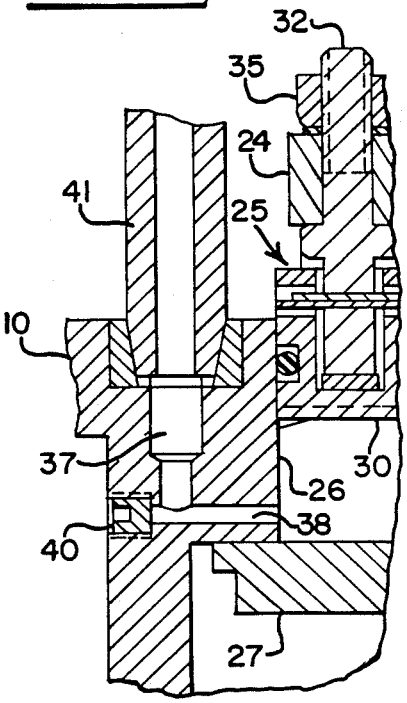
FIG. 4 is a fragmentary sectional view taken on line 4—4 of FIG. 2.

Referring to FIGS. 2 and 4, the upper cylinder 10 is provided with a passageway for hydraulic fluid in the form of a counterbore vertical passageway 37 which at the bottom joins a lateral passageway 38 which is closed at the outer end by a plug 40. A hydraulic nipple 41 is fitted into the upper end of the passageway 37.

The upper cylinder 10 is also provided with another counterbore vertical passageway 42 (FIGS. 2 and 5) which opens at its lower end into the cylinder 10 at or below the closure cap 27 so as to provide a hydraulic fluid connection into the main chamber 43 of the cylinder 10. The upper end of the passageway 42 is tapered to receive the end of a hydraulic nipple or coupling 44.

The cylinder head 10 is provided with another vertical passageway 45 (FIGS. 1 and 2) which at its bottom end communicates through a lateral port 46 into the main chamber 43. At is upper end the passageway 45 is fitted with a hydraulic nipple 47.

A piston 48 is located in the upper end of the main chamber 43 of the upper cylinder head 10 and in its uppermost position abuts against the underside of the cap 27 as shown in FIG. 1. The lower end 12 of the cylinder head 10 is closed by a cap or plug 50 which defines the bottom or closed end of the main chamber 43 and provides a stop for the downward travel of the piston 48. The plug cap 50 is screwed into the end of the lower portion 12 of the cylinder head 10 until a shoulder on the cap 50 engages a cooperating shoulder in the cylinder head 10.

The bottom end of the plug cap 50 is spaced from the upper end of the lower cylinder 11 by a washer 51 and seal ring retainer 49.

A closure cap crimping collet 52 is carried within the lower cylinder 11 and is actuated by a plunger 53 formed by an upper part 54 and a lower part 55 which projects downwardly through the collet 52 with a lower end thereof engaging the inner inclined or cam surfaces of the collet sections. At its upper end the upper plunger section 54 projects into the piston 8 and is secured thereto by a pin 57. The plunger section 54 slides vertically through a bore in the plug cap 50. Preferably, rotation of the piston 48 is prevented by means of a pin 58, the lower end of which is fixed in a socket in the plug cap 50 and the upper end of which protrudes into a vertical bore 60 in the piston 48.

A stop sleeve 61 is screwed into the lower end of the lower cylinder 11 and a seal ring 62 is mounted between the lower ends of the stop sleeve 61 and the lower sleeve 11. The outer bell 13 is provided with one or more stop screws 63, the inner ends 64 of which protrude into the interior of the bell 13 so that when the bell is in its free lowered position the pins 63 rest on the top surface of a ring 65 carried on the upper end of the inner cylinder 11. The outer bell 13 is biased toward its downward position as shown in FIG. 1 by means of a plurality of compression springs 66 circumferentially spaced around the upper cylinder head 10 and compressed between the underside of the bracket sleeve 15 and the top surface of the bell 13.

The bell 13 is provided with a counterbore lateral passageway 67 which is provided with an elbow fitting 68 which will be coupled to a vacuum line. By means of the passageway 67, vacuum may be applied to the lower interior of the bell 13 including the collet 52 and the parts that surround it.

Preferably, the lower end of the bell 13 is fitted with an adapter ring 70 which has a lower inclined seating surface 71 adapted to engage the upper end of a container or can to be filled. Since the cans or containers may have different shapes and sizes at their upper ends, it is preferred that the adapter ring 70 be made removable instead of integral with the remainder of the bell 13 so that various adapter rings can be interchanged as required. An annular gasket 72 is captured between the upper inner end of the ring 70 and a recess in the lower end of the bell 13 so as to form a seal with a can or container at a location exterior of the mouth of the container or can.

As mentioned above in one phase of the operation of the crimper head 5, fluid, either gas or liquid, is introduced under pressure into the container being filled after it has been vacuumized. Accordingly, the lower end of the bell 13 is provided with an inclined passageway 73 which communicates with an internally threaded port 74 in the bell sidewall.

Operating Sequence For Vacuumizing, Filling And Sealing

When the crimper head 5 is suspended from the support sleeve 15 and no container or can is located beneath the head, the parts of the head will occupy the relative positions shown in FIG. 1. A container to be filled with pressurized propellant and/or product will be delivered and accurately positioned underneath the head 5. Such a container or can is illustrated in FIGS. 10–12 at 75. The can 75 has a rolled rim mouth 76 to which will be sealed and crimped a closure 77 which usually is preassembled with a dip tube 78 and spray nozzle 80. The closure rim is lined with a top gasket 79 of known type. When the container 75 is delivered to the crimper head 5, the closure 77 and its assembled parts will normally be loosely resting in place on the mouth 76.

The cam operated and controlled support post 17 will be actuated so as to lower the crimper head 5 whereby the adapter 70 engages the top of the container 75 and the gasket 72 forms a seal with the container around the outside of the rim or closure mouth 76. As the head 5 is further lowered, the upper cylinder head 10 and lower cylinder 11 and the component parts carried thereby will be lowered while the bell 13 remains stationary. This lowering movement continues until the lateral passageway 81 (FIG. 1) in the lower cylinder 11 comes into registry with the vacuum port 67 as shown in FIG. 7 whereby vacuum can be applied to the bottom end of the bell 13 and to the container 75. The vacuum will suffice to lift the closure 77 and its assembled parts from the mouth 76 of the container 75 as illustrated in FIG. 10 so that any residual air within the container 75 and within the lower portion of the bell 13 may be removed. The condition and relative positions of the parts of the crimper head 5 during the vacuumizing step are shown in FIG. 7. The parts will remain in the relationship shown in FIG. 7 until the vacuum step is complete whereupon the post 17 is further lowered and the parts will occupy the relative positions shown in FIG. 8. In this position, it will be seen that the stop surface of the stop sleeve 61 will rest on the top surface of the closure 77 which in turn will rest on the container mouth 76. At this point in the cycle of operation, propellant or product in either liquid or gaseous form is introduced under pressure into the lower end of the bell through the passageway 73 and port connection 74. The resultant pressure build-up in the lower end of the bell 13 will cause the closure 77 and the lower cylinder 11 and the upper cylinder head 10 and all of the parts assembled thereto to rise while the bell 13 remains stationary by reason of the downward force exerted thereon by the compression springs 66. Since the crossbar 24 is also held stationary, the cylinder head 10 will rise until it engages the underside of the crossbar 24. During this lifting movement, it will be seen that the closure cap 27 of the well or cylindrical opening 26 in the head 10 will approach the underside of the piston 30 thereby reducing the volume of the space 26.

When the introduction of pressurized propellant or other fluid has ceased as described in the Stanley and Rousseau U.S. Pat. No. 3,157,974, the pressure will still be trapped in the bottom of the bell 13 and in the headspace of the container 75 so that the condition of the crimper head parts will remain as shown in FIG. 8 with the upper cylinder head 10 engaging the underside of the crossbar 24. At this point in the cycle, pressure is applied, such as by way of hydraulic fluid, through the passageways 37 and 38 (FIG. 4) into the reduced space between the underside of the piston 30 and the top side of the closure cap 27. This pressure will suffice to force the upper cylinder head 10 and parts assembled thereto downward until their movement is arrested when the closure 77 engages the mouth 76 of the container 75. During this movement, the parts assembled to the cylinder head 10 and to the lower cylinder 11 are also lowered to their relative positions shown in FIG. 9 and diagrammatically illustrated in FIG. 12. In this condition, the closure 77 is seated on the mouth 76 and the lower ends of the collet segments engage the closure cap 77 inwardly of its outer downwardly curved annular rim. The bottom end 61A of stop sleeve 61 (FIG. 9) will be engaged with the top of the closure cap and seal ring 62 will engage the outer periphery of the closure cap. Hydraulic fluid under pressure is now admitted through the passageway 42 (FIG. 5) in the upper cylinder head 10 by way of the nipple 44 whereby the hydraulic fluid under pressure is applied to the top surface of the piston 48. The piston and the collet actuating plunger 53 are forced downwardly causing the bottom ends of the collet segments to spread apart and thereby crimp the closure 77 with its gasket 79 to the mouth 76 of the container 75. When the crimping action has been completed, the hydraulic fluid that has entered above the piston 48 and below the closure cap 27 will be vented while hydraulic fluid under high pressure is admitted into the passageway 45 (FIG. 1) so as to enter the space 43 between the underside of the piston 48 and the top of the plug cap 50. As the piston 48 is forced upwardly by reason of this pressurized hydraulic fluid, the hydraulic fluid above the piston 48 will be expelled through the passageway 42.

In actual practice, the cycle of operations described above with respect to the crimping head 5 will be carried out in about 2 seconds once the bell 13 of the head has been seated on the can or container 75.

The Prior Art

For a description of the prior art as it relates to the crimper head 5 reference may be had to FIG. 12 wherein component parts corresponding to those of the crimper head 5 are indicated by corresponding reference numerals with primes. In the prior art crimper head 5' the upper cylinder head 10' is continuously biased against lifting by four preloaded compression springs 90—90 the upper ends of which are enclosed in tubular caps 91 against the top of which the heads of anchor bolts 92 are engaged with the lower ends of these bolts extending downwardly into the support sleeve 15'. Thus, in order for the components of the crimper head 5' other than its stationary outer bell (not shown) to lift, the pressure within the lower end of the bell must be sufficient to overcome the downward compression force of the springs 90. On the other hand, when introduction of propellant or other pressurized product during fill-phase of the operation has been completed, the force of the springs 90 must be sufficient so as to return the upper cylinder head 10' and its associated parts against the force of the residual pressure so that the closure is seated against the mouth of the container being filled.

In the crimper head 5', there is a center bore through the upper end of the cylinder head 10' which in the lower part receives a piston stop 93 which has on its bottom end a circular plate 94 which engages the upper surface of the piston 48'. Hydraulic fluid under pressure is introduced to the top of the piston 48' through a passageway (not shown) in the upper cylinder head 10. The collet actuating plunger 54' is forced downwardly when hydraulic fluid under pressure is introduced to the top of piston 48' thereby forcing the piston 48' downwardly. The piston 48' is returned to its upward position shown in FIG. 12 by admission of hydraulic fluid under pressure through the passageway 45' into the chamber 43 beneath the piston 48'.

The embodiment of the crimper head 5 shown in FIG. 1 has the following above-mentioned advantages over the crimper head 5' of the prior art shown in FIG. 12: Improved safety, reduced wear, decreased propellant and operating pressures, elimination of high pressure propellant pumps which are costly and expensive to maintain, minimized lift resistance, earlier positive closure sealing, increased output, reduced propellant loss, entire container opening available during fill instead of a restricted slit clearance thereby reducing tendency to dislodge closure gaskets, reduced seal loading, reduced can loading, and increased output.

A second embodiment of the invention is shown in FIGS. 14 and 15 wherein the pre-loaded compression springs 90 of the prior art crimper head 5 of FIG. 13 are removed and replaced by two diagonally opposed hydraulic piston assemblies one of which is indicated generally at 100. These two assemblies 100 collectively function in generally the same way as the piston assembly 25 in the first embodiment shown in FIG. 1.

Each piston assembly 100 comprises a stationary piston 101 having a stem 102, the bottom end of which has a bolt-like extension 103 which is fastened into the bracket sleeve 15'. The piston 101 fits in the bore of a cylinder block 104 which in the non-operating condition of the crimping head 5' rests on the top of the upper cylinder head 10' as shown. Each cylinder block 104 has a passageway 105 which has two ports. One port is connected to a hydraulic hose 106 connected to a source of pressurized hydraulic fluid. The other (upper) port is connected to one end of a hydraulic hose 107 the other end of which is connected to the upper port of the diagonally opposed cylinder block.

The fluid in hose 106 will not be pressurized except during the crimping portion of the cycle of the crimping head 5'. Thus, during the pressure fill portion of the cycle (FIG. 11), the upper cylinder head 10' and parts assembled thereto, including the cylinder blocks 104 will be free to rise since there will be no pressure under the pistons 101 to resist. The pistons 101 remain stationary since they are anchored to the sleeve 15'. When the crimping portion of the cycle is reached, hydraulic fluid under sufficient pressure is introduced into the passageway 105 of each cylinder block so as to force each cylinder block 104 downward until the cylinder head 10' engages the bracket sleeve 15'.

Preferably, the two diagonally opposed compression springs 90 (FIG. 13) not replaced by the piston assemblies 100 are replaced with two shoulder bolts (not shown) fastened to the bracket sleeve 15' so that upward motion during pressure fill is stopped by the cylinder head 10' engaging these bolts before the cylinder blocks 104 engage the pistons 101.

While the crimper head 5 of FIGS. 1–9 and the modification of FIGS. 14 and 15 have been described for use in an undercap filler type of operation, the same crimping heads can be used for crimping closure caps onto containers, omitting the undercap filling operation. Thus, the crimper head 5 can be supplied with containers that will usually already have been filled with product and on which the closure cap assemblies have already been set or inserted in place on the containers Usually, it will be desired to draw a vacuum on the containers and this step may be performed as described above, particularly in connection with FIGS. 7 and 10. Following the vacuum step the upper cylinder head 10 and the associated parts can be lowered by the operating rod 17 so that the closure cap is seated on the container and ready for crimping as described in connection with FIGS. 9 and 12. In this sequence, it will be noted that the undercap introduction of pressurized product or propellant through the opening 73 will have been omitted. With the crimper head in the condition illustrated in FIGS. 9 and 12, hydraulic pressure is introduced into the reset cylinder through the passageway 37–38 so as to apply a desired preload force of the lower end 61A of the stop sleeve 61 against the top of the closure 77. With this preload or hold-down force of the desired magnitude being applied, the collet 55 is actuated by admitting pressure through the passageway 42 thereby forcing down the piston 48 as previously described and crimping the closure 77 to the mouth 76. Thereafter, propellant under pressure can be introduced in known manner through the valve 80 in a so-called pressure-filler.

It will be understood that the preload or hold-down pressure applied by means of the piston assembly 25 (or the cylinder units 100 of FIG. 14) may be varied to suit the specifications for different types of closure caps lined with different types of gaskets 79. Thus, the desired preload of hold-down forces can be achieved by regulating the pressure applied to the piston assemblies 25 or 100. Such regulation can be readily obtained in any desired known manner.

What is claimed is:

1. In a crimper head for use in introducing fluid under pressure into the mouth of an open container provided with an unsecured closure and thereafter crimping the closure to said mouth comprising, an upper cylinder closed at its upper and lower ends and having flange means which can rest on a support sleeve in which it is vertically reciprocal, a piston operable in said upper cylinder, a lower cylinder attached to said lower end of said upper cylinder and depending co-axially therefrom, a hollow collet co-axially mounted in said lower cylinder, plunger means attached at its upper end to said piston and extending downwardly through a bore in said lower end of said upper cylinder and into said collet for distending the bottom end of said collet, a container-engaging bell surrounding said lower cylinder and the lower end of said upper cylinder and reciprocal with respect to said lower cylinder and said lower end of said upper cylinder, said bell and said lower cylinder having cooperating transverse vacuum-transmitting passageways arranged to register only when said bell occupies a particular vertical position relative to said lower cylinder to thereby establish vacuum communication through said bell and said lower cylinder into an annular clearance region that encircles said collet internally of said lower cylinder and which region opens downwardly into the lower end of said bell for communication with said container, said bell having a second passageway for admitting fluid under pressure into the lower portion of said bell and into a said container engaged by said bell, said upper cylinder having a passageway communicating from its exterior into its interior at a location above said piston and a second passageway communicating from its exterior into its interior below said piston, and all the above-mentioned elements of said head except said bell being collectively vertically reciprocal as a unit between raised and lower positions with respect to said bell when the latter stationarily engages a said container and being collectively lifted with respect to said container-engaging bell and said support sleeve when fluid under sufficient pressure is admitted into said bell through said second passageway, and means for lowering said collectively lifted elements of said crimper head as a unit against the upward lifting force of pressurized fluid retained in the lower portion of said bell comprising, cylinder means carried by said closed upper end of said upper cylinder, fixed piston means operable within said cylinder means, and means fixedly supporting said fixed piston means from said support sleeve at an elevation whereby a closed space forms within said cylinder means under said fixed piston means when said collectively liftable elements are in their said lowered position, said closed space being appreciably reduced when said collectively liftable elements are in their said lifted positions, said cylinder means having passageway means whereby fluid under pressure may be admitted to said reduced space to lower said cylinders means and said collectively lifted elements to an elevation wherein said collect has crimping engagement with a said closure seated on said container mouth.

2. In a crimper head as called for in claim 1 wherein said cylinder means carried by said closed upper end of said upper cylinder is formed within said closed upper end.

3. In a crimper head as called for in claim 1 wherein said cylinder means carried by said closed upper end of said upper cylinder is a single cylinder formed by a bore in said closed upper end and co-axial with said upper cylinder with means closing the bottom of said bore.

4. In a crimper head as called for in claim 1 wherein said cylinder means carried by said closed upper end of said upper cylinder comprises at least one cylinder block supported by engagement with the top of said closed upper end.

5. In a crimper head as called for in claim 4 said cylinder means comprising a plurality of said cylinder blocks symmetrically positioned with respect to the axis of said upper cylinder.

6. In a crimper head as called for in claim 5 said means for fixedly supporting said fixed piston means comprises stems depending from said fixed piston means and secured in said support sleeve.

7. In a crimper head for use in introducing fluid under pressure into the mouth of an open container provided with an unsecured closure and thereafter crimping the closure to said mouth comprising, an upper cylinder closed at its upper end having flange means which can rest on a support sleeve in which it is vertically reciprocal, a piston operable in said upper cylinder, a lower cylinder attached to said lower end of said upper cylinder and depending co-axially therefrom, a hollow collet co-axially mounted in said lower cylinder, plunger means attached at its upper end to said piston and extending downwardly through a bore in said lower end of said upper cylinder and into said collet for distending the bottom end of said collet, a container-engaging bell surrounding said lower cylinder and the lower end of said upper cylinder and reciprocal with respect to said lower cylinder and said lower end of said upper cylinder, said bell and said lower cylinder having cooperating transverse vacuum-transmitting passageways arranged to register only when said bell occupies a particular vertical position relative to said lower cylinder to thereby establish vacuum communication through said bell and said lower cylinder into an annular clearance region that encircles said collet internally of said lower cylinder and which region opens downwardly into the lower end of said bell for communication with a said container, said bell having a second passageway for admitting fluid under pressure into the lower portion of said bell and into a said container engaged by said bell, said upper cylinder having a passageway communicating from its exterior into its interior at a location above said piston and a second passageway communicating from its exterior into its interior below said piston, and all the above-mentioned elements of said head except said bell being collectively vertically reciprocable as a unit between raised and lower positions with respect to said bell when the latter stationarily engages a said container and being collectively lifted with respect to said container-engaging bell when fluid under sufficient pressure is admitted into said bell through said second passageway; and means for lowering said collectively lifted elements of said head as a unit against the upward lifting force of pressurized fluid retained in the lower portion of said bell comprising, a fixed piston operable within a cylinder well formed in said closed upper end of said upper cylinder, and means supporting said fixed piston at an elevation whereby a closed space is formed in said cylinder well between the bottom of said well and the bottom of said fixed piston when all of said collectively liftable elements are in their said lowered position, said closed space being reduced when said collectively liftable elements are in their said lifted position, said closed upper end of said upper cylinder having a passageway communicating between its exterior and the lower end of said cylinder well whereby fluid under pressure may be admitted to said well and said reduced space to lower said collectively lifted elements to an elevation wherein said collet has crimping engagement with said closure seated on said container mouth.

8. In the crimper head called for in claim 7 said means for stationarily supporting said fixed piston comprising, a crossbar, means for horizontally and stationarily supporting said crossbar from said support sleeve and above said upper end of said upper cylinder, and a stem extending vertically downwardly from said crossbar in co-axial alignment with said cylinder well in the upper end of said upper cylider, said fixed piston being mounted on the lower end of said stem.

9. In the crimper head called for in claim 8, said fixed piston being vertically adjustable in a range of positions relative to said crossbar.

10. In the crimper head called for in claim 8, said stem being vertically adjustable on said crossbar.

11. In the crimper head called for in claim 8, said cylinder well in the closed upper end of said upper cylinder being formed by a co-axial bore through said closed upper end and a cap closing the bottom end of said co-axial bore and secured to the interior underside of said upper end.

12. In a crimper head for use in crimping a closure onto the mouth of an open container comprising, an upper cylinder closed at its upper and lower ends and having flange means which can rest on a support sleeve in which it is vertically reciprocal, a piston operable in said upper cylinder, a lower cylinder attached to said lower end of said upper cylinder and depending co-axially therefrom, a collet co-axially mounted in said lower cylinder, plunger means attached at its upper end to said piston and extending downwardly through a bore in said lower end of said upper cylinder and into said collet for distending the bottom end of said collet into crimping engagement with said closure, a stop sleeve mounted in said lower cylinder and surrounding said collet having a lower end which has hold-down engagement with said closure when said collect has said crimping engagement with said closure, a container-engaging bell surrounding said lower cylinder and reciprocal with respect to said lower cylinder, said bell and said lower cylinder having cooperating vacuum-transmitting passageways arranged to register only when said bell occupies a particular vertical position relative to said lower cylinder to thereby establish vacuum communication through said bell and said lower cylinder into an annular clearance region that encircles said collet internally of said lower cylinder and which region opens downwardly into the lower end of said bell for communication with said container, said upper cylinder having a passageway communicating from its exterior into its interior at a location above said piston and a second passageway communicating from its exterior into its interior below said piston, and all the above-mentioned elements of said head except said bell being collectively vertically reciprocal as a unit between a raised position and a lowered position with respect to said bell when the latter stationarily engages a said container, in said lowered position said collet having said crimping engagement and said stop sleeve having said hold-down engagement with said closure, and means for controlling the force of said hold-down engagement comprising, cylinder means carried by said closed upper end of said upper cylinder, fixed piston means operable within said cylinder means, and means fixedly supporting said fixed piston means from said support sleeve, said cylinder means having passageway means whereby fluid under pressure may be admitted into said cylinder means to exert a downward force thereon.

13. In a crimper head as called for in claim 12 wherein said cylinder means carried by said closed upper end of said upper cylinder is formed within said closed upper end.

14. In a crimper head as called for in claim 12 wherein said cylinder means carried by said closed upper end of said upper cylinder is a single cylinder formed by a bore in said closed upper end and co-axial with said upper cylinder with mean closing the bottom of said bore.

15. In a crimper head as called for in claim 12 wherein said cylinder means carried by said closed upper end of said upper cylinder comprises at least one cylinder block supported by engagement with the top of said closed upper end.

16. In a crimper head as called for in claim 15 said cylinder means comprising a plurality of said cylinder blocks symmetrically positioned with respect to the axis of said upper cylinder.

17. In a crimper head as called for in claim 16 said means for fixedly supporting said fixed piston means comprises stems depending from said fixed piston means and secured in said support sleeve.

18. In the crimper head called for in claim 12, said means for stationarily supporting said fixed piston comprising, a crossbar, means for horizontally and stationarily supporting said crossbar from said support sleeve and above said upper end of said upper cylinder, and a stem extending vertically downwardly from said crossbar in co-axial alignment with said cylinder well in the upper end of said upper cylider, said fixed piston being mounted on the lower end of said stem.

19. In the crimper head called for in claim 18, said fixed piston being vertically adjustable in a range of positions relative to said crossbar.

20. In the crimper head called for in claim 18, said stem being vertically adjustable on said crossbar.

21. In the crimper head called for in claim 18, said cylinder well in the closed upper end of said upper cylinder being formed by a co-axial bore through said closed upper end and a cap closing the bottom end of said co-axial bore and secured to the interior underside of said upper end.

* * * * *